US006012933A

United States Patent [19]

Katsuma

[11] Patent Number: 6,012,933

[45] Date of Patent: Jan. 11, 2000

[54] LEVER TYPE CONNECTOR

[75] Inventor: Takatoshi Katsuma, Yokkaichi, Japan

[73] Assignee: Sumitomo Wiring Systems, Ltd., Japan

[21] Appl. No.: 08/906,593

[22] Filed: Aug. 5, 1997

[30] Foreign Application Priority Data

Oct. 3, 1996 [JP] Japan ..... 8-263280

[51] Int. Cl.[7] ..... H01R 13/62

[52] U.S. Cl. ..... 439/157; 439/160

[58] Field of Search ..... 439/157, 372, 439/160

[56] References Cited

U.S. PATENT DOCUMENTS 5,482,394 1/1996 Shinchi et al. ..... 439/157
5,509,816 4/1996 Katsuma ..... 439/157
5,562,465 10/1996 Taguchie et al. ..... 439/157

FOREIGN PATENT DOCUMENTS 0 717 466 6/1996 European Pat. Off. .
07-230850 8/1995 Japan .

*Primary Examiner*—Michael L. Gellner
*Assistant Examiner*—Briggitte R. Hammond
*Attorney, Agent, or Firm*—Banner & Witcoff, Ltd.

[57] ABSTRACT

A lever-type electrical connector has resilient return members 40 which extend so as to cut across a radius of a circle which is the center of rotation of the lever 30, and have an anterior end 41 which bends outwards along the radial direction. In this configuration, the anterior end of the pushing member 40 does not protrude excessively from the arm 31, thereby allowing the interaction region of the pushing member 40 that accompanies the pivoting of the lever 30 to be small. Furthermore, the anterior end 41 is pushed in a straight line against the protrusion 25, and thus the return force is more effective.

11 Claims, 4 Drawing Sheets

LEVER TYPE CONNECTOR

TECHNICAL FIELD

The present invention relates to a lever-type electrical connector.

BACKGROUND TO THE INVENTION

A lever-type connector is described in the Japanese Laid-Open Publication 7-230850 and is described hereinbelow with the aid of FIGS. 6 and 7 of this specification. A pivotable lever 2 provided on a connector housing 1 has a pair of arms 3. When the lever 2 is pivoted, resilient members 4 provided on the arms 3 of the lever 2 bend on making contact with protrusions 8 provided on the connector housing 1.

In order to fit the connector housing 1 with a corresponding connector housing 6, the lever 2 is pivoted and cams 3A of the arms 3 cause protrusions 7 on the connector housing 6 to be guided therein. When the connectors 1 and 6 are completely fitted together, a latch 5 of a lever 2 fits with a receiving member 1A of the connector housing 1. During the pivoting movement of the lever 2, the resilient member 4 makes contact with the protrusion 8 and bends, causing a return force to build up. If the movement of the lever 2 is stopped when the connectors 1 and 6 are in a half-fitted state, this force causes the lever 2 to be pushed back, thereby signalling a half-fitted position to an operator.

However, in the lever-type connector described above, the resilient member 4 is provided at a location that is offset (see symbol F in FIG. 7) from the pivoting axis of the lever 2, and for this reason the direction of the return force (the direction of an arrow B in FIG. 7) from the protrusion 8 with respect to the bent member 4 does not correspond to the direction of the moment of the closing force (the direction of an arrow A in FIG. 7). This results in a reduction in the effective return force. Consequently, a problem exists in that an effective pushing force on the corresponding connector housing may not be achieved.

The present invention has been developed after taking the above problem into consideration, and aims to present a lever-type connector which can reliably signal a half-fitted position.

SUMMARY OF THE INVENTION

According to the invention there is provided a lever type connector comprising a body, and a 'C' shaped lever pivoted on the body, the lever having opposite arms pivoted at one respective end to the body about a common axis and linked at the other respective end by an operating member, wherein the arms each have resilient cantilever members engageable with respective protrusions of the body to urge the lever against arcuate movement in one direction, the cantilever members each having a contact portion extending along a radius of a circle having said common axis as centre.

Such an arrangement ensures that the return force acting on the lever is on a radius of the pivoting axis of the lever, and is thus of maximum effect. This is in contrast with the prior art where the point of action of the return force is offset from a radius of the pivoting axis and this does not act orthogonally.

Preferably each cantilever member has a root adjacent the common axis, an inner portion extending across a radius of a circle having the common axis as centre, and a free end comprising the contact portion. In this way the root can be offset from the pivoting axis, yet the free end can lie along a radius, thus giving maximum return effective force. This arrangement ensures that the inner portion can be long, if required of bent, humped or spiral shape, and this ensures an effective spring within the envelope of the connector, especially a miniaturized connector. This arrangement also has the advantage of allowing the cantilever member to lie within the envelope of the lever, and not to protrude therefrom; this reduces the risk that the protruding end of the cantilever may be damaged or break off during manufacture and assembly.

BRIEF DESCRIPTION OF DRAWINGS

Other features of the invention will be apparent from the following description of preferred embodiments shown by way of example only in the accompanying drawings in which.

DESCRIPTION OF PREFERRED EMBODIMENT

An embodiment of the present invention is explained below, with the help of FIGS. 1 to 4.

Figure 1:
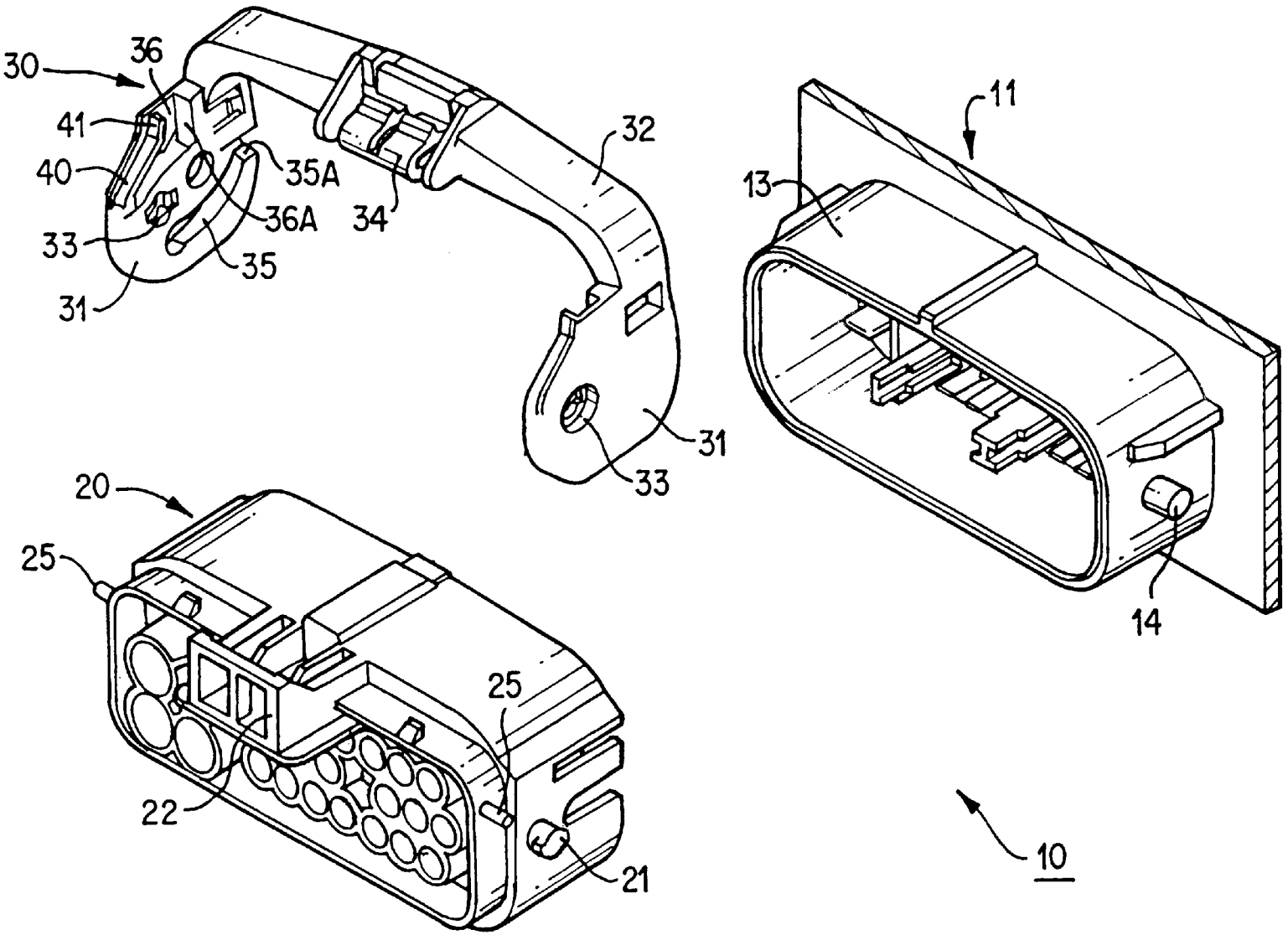
FIG. 1 is an exploded diagonal view of a lever-type connector of the present invention.
Figure 2:
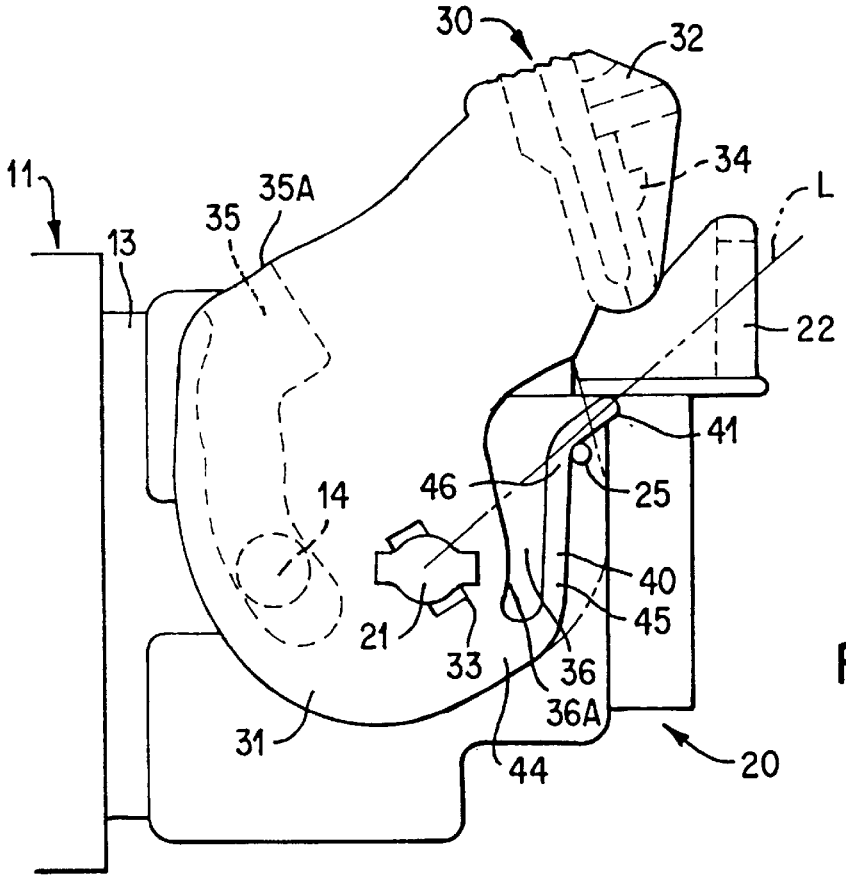
FIG. 2 is a side view showing a pushing member in contact with a protruding member.
Figure 3:
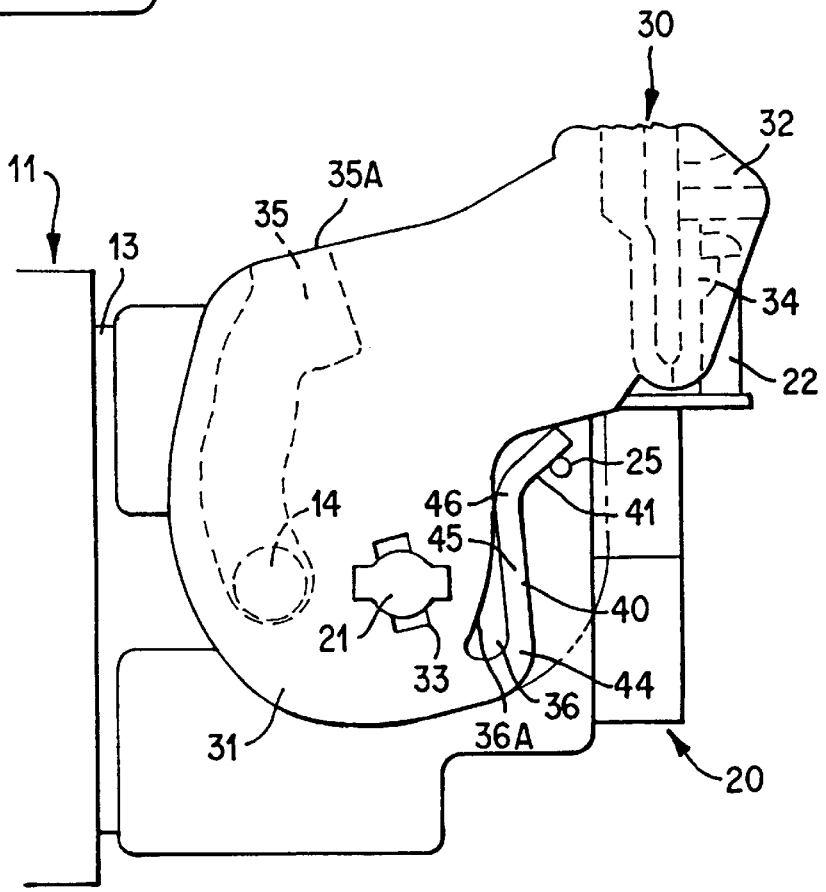
FIG. 3 is a side view showing the pushing member in a bent state.

Numeral 10 in FIG. 1 represents a lever-type connector comprising a female connector housing 20 having a plurality of female terminal fittings therein, and a lever 30 which is attached to the female housing 20 so as to straddle it in its width-wise direction. Arcuate movement of the lever 30, by means of a light operative force draws a male connector housing 11 thereto, the male housing having male terminal fittings which can make contact with the female terminal fittings.

The male connector housing 11 (only a portion thereof is shown in FIG. 1) has cylindrical cam receiving protrusions 14 formed so as to protrude outwards from both side walls of a hood member 13.

Both side faces of the female connector housing 20 have supporting axes 21 protruding outwards, and also have protrusions 25 that protrude similarly and are located somewhat posteriorly with respect to the supporting axes 21, in the direction of fitting and slightly closer to the upper face, as viewed. The lever 30 is attached to the supporting axes 21.

The lever 30 has arms 31 which have an operation member 32 serving as a bridge therebetween, the lever 30 thereby being shaped like an arched gateway. The supporting axes 21 fit into axial receiving holes 33 formed on the arms 31, and, as described above, the lever 30 becomes arcuately moveable with respect to the female connector housing 20. The centre of the operation member 32 has a bendable latch 34 provided thereon which fits with a fitting member 22 provided on the upper face of the female connector housing 20.

The facing faces of the arms 31 have cam grooves 35 formed therein. One end of each cam groove 35 is located in the vicinity of the axial receiving hole 33, and the other end opens towards the outer periphery of the arm 31 forming a protrusion entry hole 35A. In use, the entry hole 35A is made to face the protrusion 14 which is thus brought into the cam groove 35. In this state, when the lever 30 is pivoted, the protrusion 14 is guided therein. When the latch 34 reaches a position whereby it is stopped by the fitting member 22, the connector housings 11 and 20 are in a completely fitted state. Separating the fitting of the bendable latch 34 and pivoting the lever 30 in the opposite direction causes the connector housings 11 and 20 to separate.

The arms 31 have spaces 36 formed at locations opposite, with respect to the axial receiving holes 33, to the cam grooves 35, these spaces 36 opening out into the interior and towards the sides. The spaces 36 extend from the vicinity of the axial receiving holes 33 approximately in a parallel manner to the cam grooves 35, their interior having cantilevered pushing members 40 which extend along inner peripheral faces 36A. Each pushing member 40 has as its root 44 a location in the inner peripheral face 36A that is closer to the axis of rotation of the lever 30. From this point, an inner portion 45 extends in a direction that laterally cuts across a radius of a circle described with the axis of pivoting as centre. An anterior end contact point 41 thereof turns outwards at bend 46 to extend in the radial direction, indicated in FIG. 2 by radial line L. Anterior end 41 has a longitudinal axis extending along a radial line L between bend 46 and a terminal portion of the anterior end 41.

When the lever 30 is pivoted so as to draw the connector housings together, the anterior end 41 makes contact with the protrusion 25 before the latch 34 is engaged. At this juncture, if the lever 30 is pivoted further, just before latching, the pushing member 40 is pushed by the protrusion 25 and bends, thereby building up a return force for pushing the lever 30 in the opposite direction.

In this way, since the pushing member 40 has only the anterior end 41 extending in the radial direction and the rest of the pushing member 40 extends in a direction laterally cutting across the radial direction, there is no need to make the interaction region during the pivoting of the lever 30 wider than the interaction region of the arms 31. Consequently, an effect is achieved whereby the lever-type connector as a whole can be miniaturised while retaining a relatively large pushing member.

Figure 4:
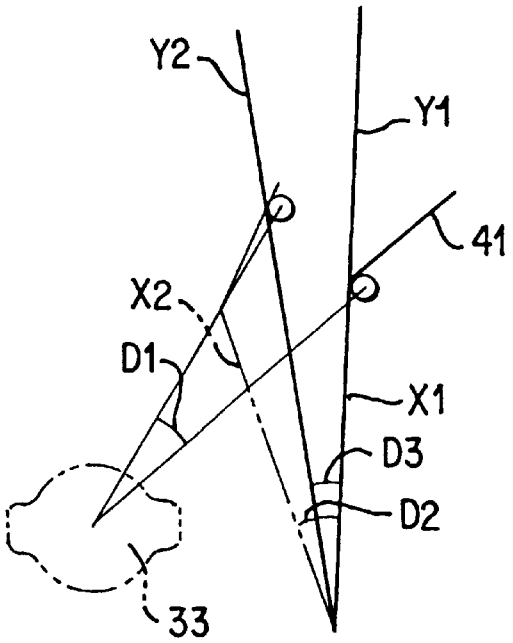
FIG. 4 is a schematic diagrammatic view showing the bending angle of the pushing member.

Further, since the anterior end 41 extends in the radial direction, the direction of the force received from the protrusion 25 corresponds to the direction of the force that rotates the lever 30, and thus the return force built up in the pushing member 40 is used effectively in pushing back the lever 30. Apart from this, it also has the following effect, described with the aid of FIG. 4, and comparing with the case where the anterior end 41 is not extended in the radial direction. FIG. 4 selectively shows only the face facing the protrusion 25 of the pushing member 40. Further, the figure shows a state whereby the lever 30 is pivoted and the pushing member 40 bent, the protrusion 25 being rotated relatively to the lever 30.

When the lever 30 is pivoted immediately after the pushing member 40 and the protrusion 25 make contact (the symbol X1 of FIG. 4), the pushing member 40 gets bent (as shown by the symbol X2), by approximately the same angle (D2) as the angle of rotation of the lever 30 (D1). As opposed to this, as shown by Y2, in the case where the anterior end of the pushing member is not bent, the protrusion 25 moves along the pushing member, and since the direction of pushing in the bending direction is small, as shown by D3, the bending does not exceed an angle (D3) that is smaller than the angle of rotation D2 of the lever 30.

In order to connect the male and female connectors of the lever-type connector 10, the cam receiving protrusion 14 of the male connector housing 11 is introduced into the cam groove 35 of the lever 30 and the lever 30 is pivoted. When this is done, the anterior end 41 of the pushing member 40 makes contact with the protrusion 25 (see FIG. 2). From this state, when the lever 30 is further pivoted, the free end of the pushing member 40 is engaged by the protrusion 25 and bends, and a return force is built up for moving the lever 30 in the opposite direction. When the connector housings 11 and 20 reached a completely fitted state, the latch 34 and the fitting member 22 fit together, making it impossible for the lever 30 to return in the opposite direction.

In the case where the connector housings 11 and 20 are in a half-fitted state, the lever 30 is in the process of being pivoted. Here, the problem is that before the latch is engaged, a position is reached whereby it may be difficult for the half-fitted state to be signalled. However, in the present embodiment, while the lever 30 is being pivoted and the connector housings 11 and 20 fitted together, the anterior end 41 of the pushing member 40 is pushed by the protrusion 25 and by being bent sufficiently builds up a greater opposing force. This opposing force can be more effectively converted into a return force for the lever 30. By these means, when the latch 34 is not engaged, even if the operator stops the pivoting operation, the lever 30 is pushed to the state shown in FIG. 2, and due to this the operator can detect a half-fitted state.

Figure 5:
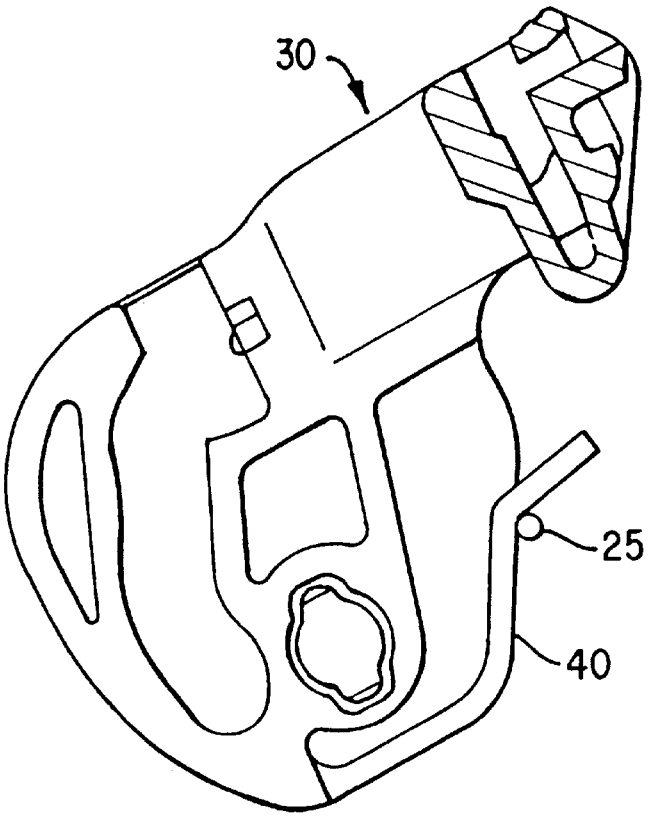
FIG. 5 is a cross-sectional side view showing a variation of the lever.
Figure 6:
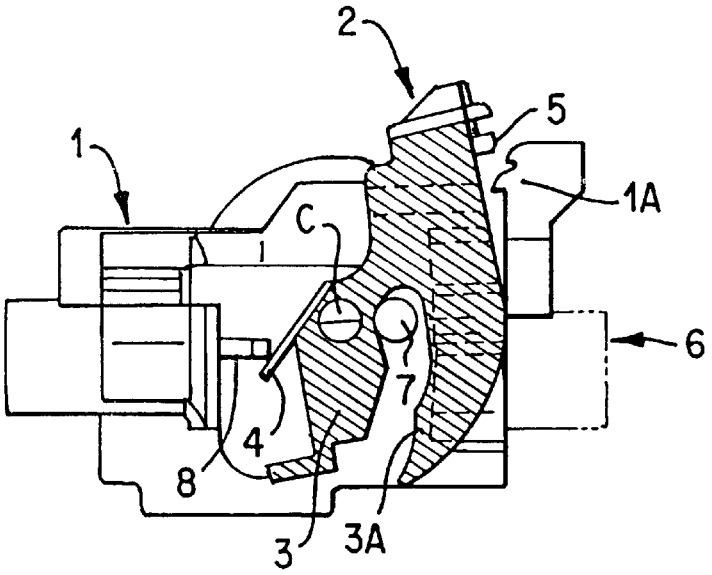
FIG.6 PRIOR ART
FIG. 6 is a side view of a prior art lever-type connector.
Figure 7:
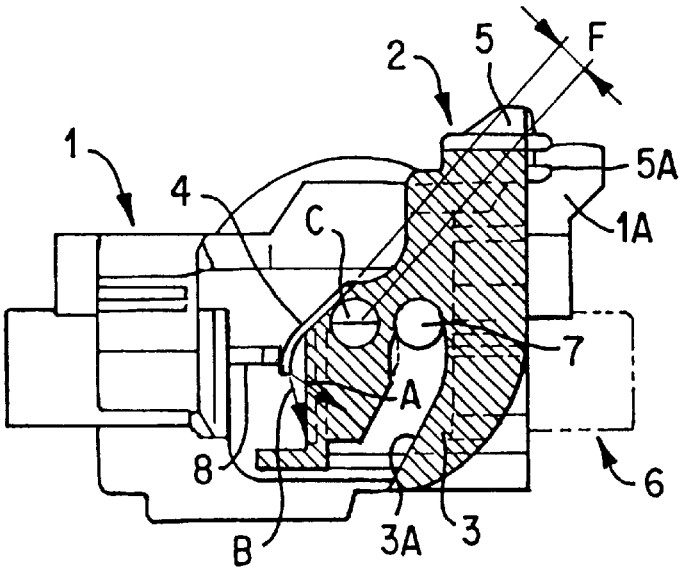
FIG.7 PRIOR ART
FIG. 7 is a side view showing the fitted state of the prior art lever-type connector.

The present invention is not limited to the embodiments described above with the aid of figures. For example, as shown in FIG. 5, the base portion of the pushing member 40 may be arranged to be bent into a hump shape or to be spirally curved. In addition, the present invention may be embodied in various other ways without deviating from the scope thereof.

I claim:

1. A lever type connector comprising a housing with a pair of protrusions, and a 'C' shaped lever pivoted on the housing, the lever having opposite arms pivoted at one respective end to the housing about a common axis and linked at the other respective end by an operating member, wherein the arms each have a resilient cantilever member with a contact portion to engage one of said protrusions of the housing and thereby resist arcuate movement of the lever in one direction about the common axis, the contact portion of each cantilever member having a longitudinal axis located along a line extending radially from said common axis.

2. A connector according to claim 1 wherein each of said cantilever members are generally coplanar with one of said arms.

3. A connector according to claim 1 wherein said cantilever members do not laterally protrude from said arms.

4. A connector according to claim 1 wherein said cantilever members each have a root adjacent said common axis, an inner portion projecting outwardly at an inclination to said root, and a free end comprising said contact portion.

5. A connector according to claim 4 wherein the lever is pivotable to an end stop, and said cantilever members and respective protrusions first engage near said end stop.

6. A connector according to claim 4 wherein the meeting of the inner portion and contact portion of each of said cantilever members comprise a bend.

7. A connector according to claim 6 wherein said cantilever members and respective protrusions first engage at said bend.

8. A connector according to claim 5 wherein the meeting of the inner portion and contact portion of each of said cantilever members comprise a bend.

9. A connector according to claim 8 wherein said cantilever members and respective protrusions first engage at said bend.

10. A connector according to claim 1 and further including latch members on said lever and said housing, said latch members being engageable to hold said lever and said housing against relative movement.

11. A connector according to claim 10 wherein said resilient cantilever members resist the movement of said latch members toward each other.

* * * * *